US005439167A

United States Patent [19]

Focke et al.

[11] Patent Number: 5,439,167

[45] Date of Patent: Aug. 8, 1995

[54] PACKAGE MADE OF CARDBOARD

[75] Inventors: Heinz Focke; Martin Stiller, both of Verden, Germany

[73] Assignee: Focke & Co. (GmbH & Co.), Verden, Germany

[21] Appl. No.: 250,923

[22] Filed: May 31, 1994

Related U.S. Application Data

[62] Division of Ser. No. 991,539, Dec. 15, 1992, Pat. No. 5,336,154.

[30] Foreign Application Priority Data

Dec. 17, 1991 [DE] Germany ..... 41 41 678.3

[51] Int. Cl.[6] ..... B65D 5/66

[52] U.S. Cl. ..... 229/160.1; 206/268; 206/273

[58] Field of Search ..... 229/160.1, 9, 19; 206/268, 271, 273

[56] References Cited

U.S. PATENT DOCUMENTS

| | | | |
|---|---|---|---|
| 994,946 | 7/1911 | Bair . | |
| 1,888,855 | 11/1932 | Fuller | 229/9 |
| 2,256,257 | 9/1941 | Dukehart, Jr. | 229/9 |
| 3,163,095 | 12/1964 | Sheeran . | |
| 3,446,049 | 5/1969 | Greis . | |
| 3,482,478 | 12/1969 | Einhorn . | |
| 3,521,810 | 7/1970 | Boyer | 229/9 |
| 3,823,633 | 7/1974 | Ross . | |
| 4,050,622 | 9/1977 | Shimada et al. | 229/19 |
| 4,216,898 | 8/1990 | Davies . | |
| 4,392,338 | 7/1983 | Fox . | |
| 4,629,447 | 12/1986 | Stenzel . | |
| 4,646,960 | 3/1987 | Challand . | |
| 4,725,261 | 2/1988 | Millard et al. . | |
| 5,151,077 | 9/1992 | Cole, Jr. . | |
| 5,336,154 | 8/1994 | Focke et al. | 493/352 |

FOREIGN PATENT DOCUMENTS

| | | | |
|---|---|---|---|
| 414532 | 2/1991 | European Pat. Off. . | |
| 1058709 | 3/1954 | France | 229/9 |
| 1558287 | 1/1969 | France | 229/9 |
| 1561413 | 2/1970 | Germany . | |
| 1561508 | 4/1970 | Germany . | |
| 1786304 | 12/1970 | Germany . | |
| 2259148 | 6/1974 | Germany . | |
| 2360701 | 6/1975 | Germany . | |
| 2602153 | 9/1976 | Germany . | |
| 2641933 | 3/1977 | Germany . | |
| 2647303 | 7/1977 | Germany . | |
| 7722446 | 1/1979 | Germany . | |
| 3337199 | 5/1985 | Germany . | |
| 3713612 | 11/1988 | Germany . | |
| 3738102 | 5/1989 | Germany . | |
| 4122900 | 1/1993 | Germany . | |
| 332713 | 7/1930 | United Kingdom | 229/9 |
| 1512200 | 6/1974 | United Kingdom . | |
| 2167042 | 5/1986 | United Kingdom . | |

*Primary Examiner*—Gary E. Elkins
*Attorney, Agent, or Firm*—Sughrue, Mion, Zinn, Macpeak & Seas

[57] ABSTRACT

A package made of cardboard and a process and an apparatus for producing the package are disclosed. For various reasons it is required to form projections (10), stops etc. in pack panels of packs made of (thin) cardboard. To support a collar (13) which is located in the box part (11) of a hinge-lid pack, projections (10) are disposed at the side panels (17, 18). These projections are formed from a transversely directed punch cut (21) and a convexity which adjoins this punch cut and is made by shaping the material (cardboard). A projection (10) which is designed in this manner is produced in a single working step by punching and shaping (embossing) with the aid of an appropriate tool (punching piece 24) in conjunction with a counter tool (counter roller 28) during the continuous transport of a blank.

14 Claims, 6 Drawing Sheets

PACKAGE MADE OF CARDBOARD

This is a divisional of application Ser. No. 07/991,539, filed Dec. 15, 1992, now U.S. Pat. No. 5,336,154.

BACKGROUND OF THE INVENTION

The invention relates to a package which is made of (thin) cardboard and has a projection, stop or the like which is formed in a panel of the package from the cardboard by deformation, especially a hinge-lid pack for cigarettes, having stops located at the inner side of side panels of the pack for supporting a collar. The invention further relates to a process and an apparatus for producing projections or stops in panels made of (thin) cardboard.

For various reasons it is required in the packaging art to form projecting portions in the region of a panel of a package, which portions serve as a projection or stop for positioning parts of the package. These projecting portions are for example required in hinge-lid packs for cigarettes or the like. This type of pack is provided with a collar which partially immerses in a box part of the hinge-lid pack. In order to accurately position the collar within the box part, inwardly directed stops are disposed at side panels of the box part. Lower edges of the collar bear against these stops. DE -A-41 22 900.2 is directed to a package which comprises stops for this purpose. It is difficult to produce this stop in the continuous manufacturing process. The invention provides a remedy for this problem.

SUMMARY OF THE INVENTION

It is an object of the invention to make it possible to form these projections in the course of the continuous process of manufacturing packages, especially hinge-lid packs, by means of a structural design of projections or stops formed by deformation and by means of specific measures concerning process and apparatus techniques.

To attain this object, the projection or stop is, in accordance with the invention, bounded in the cardboard by at least one punch cut and is formed from a deformation of the cardboard which is formed by embossing and which is bounded by the punch cut.

According to the invention, and in contrast to the projection or stop according to the above mentioned older suggestion, only one punch cut is required. A portion of the panel which is located adjacent to this punch cut is deformed and forms a projecting edge. As a result, a stop is made which has a supporting edge which is formed by the punch cut. The deformation has a preferably arcuate shape, so that a convexity is formed in the cardboard which is bounded by a cutting edge.

In terms of process technique, the projection or stop which is designed in this manner is made in a single working cycle, in particular by punching and simultaneous deformation or embossing of the cardboard.

The apparatus according to the invention for the production of stops or projections comprises a tool which can be pressed against the panel or the cardboard, and a corresponding counter tool. These tools simultaneously form the punch cut and a projecting deformation, especially a curved deformation.

Tool and counter tool are preferably disposed on the periphery of rotating means, especially rollers. Blanks for the package or a web of packaging material are passed through between these rollers. Tool and counter tool engage one another at least once during each rotation of the two oppositely situated rollers, in such a way that a projection/stop is formed in the blank.

In a special exemplary embodiment, the tool takes the form of a cylindrical punching piece whose (circular) end edge is, at the same time, a punching bezel. The cylindrical shell which adjoins this punching bezel effects the curved deformation of the material during punching.

The invention is particularly suitable for forming stops for supporting collars in hinge-lid packs. During the continuous transport of the blank for the hinge-lid pack or a web of packaging material, the stop is formed in the region of side panels or inner side tabs of these side panels. However, the projections or stops may also be useful in a different context.

BRIEF DESCRIPTION OF THE DRAWINGS

An exemplary embodiment of the design of the stop or projection and of the apparatus for the production of the stop or projcetion will be described below in detail with reference to the drawings, in which.

DESCRIPTION OF A PREFERRED EMBODIMENT

Figure 1:
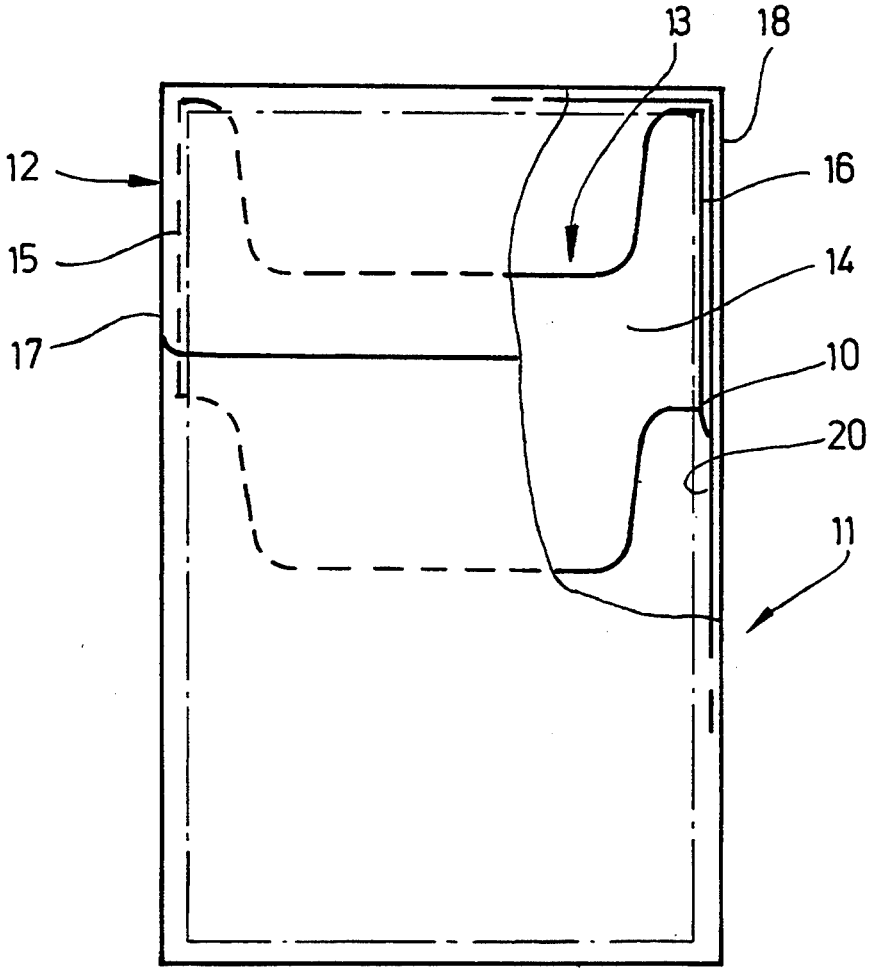
FIG. 1 shows a front view, partly in vertical section, of a hinge-lid pack for cigarettes comprising stops for a collar.

The exemplary embodiment illustrated in the drawings relates to the forming of projections 10 at or in panels of packages made of (thin) cardboard, in particular of hinge-lid packs for cigarettes. Such a hinge-lid pack is illustrated in FIG. 1 and comprises a lower box part 11 and a lid 12 connected to a rear panel of this box part. A collar 13 which is formed from a separate blank is located within the box part 11. This collar 13 comprises a collar front panel 14 and collar side panels 15, 16. The latter rest against the inner side of box side panels 17, 18, in particular against inner side tabs 19, 20 of these box side panels.

In order to accurately position the collar 13 in the box part 11, inwardly protruding projections 10 or stops are disposed at the inner side of the box side panels 17, 18, in particular at their inner side tabs 19, 20. The collar 13 bears against these projections or stops with the lower edges of the collar side panels 15, 16.

The projections 10 are made by deforming the material of a panel of the hinge-lid pack, in particular of the side tabs 19, 20. For this purpose, a transversely directed or horizontal punch cut 21 is applied. A portion which adjoins this punch cut—in the presently described exemplary embodiment below the punch cut 21—is inwardly deformed in order to form the projection 10. In this case, the deformation is designed such that a convexity 22 in the shape of an arc, especially of an arc of a circle, is formed from the packaging material. Beyond the region of the punch cut 21, this convexity gradually merges into the panel, i.e. into the side tabs 19, 20. An edge 23 of the punch cut 21 forms the supporting or bearing surface for the part (collar 13) which is to be supported.

The projection 10 which is designed in this manner is formed entirely in one working step.

For this purpose, a special punching and embossing tool is used which simultaneously forms the punch cut 21 and the deformation of the material, i.e. in this case of the side tabs 19, 20. The punching and embossing tool is a cylindrical punching piece 24. This piece has the shape of a pin. A transversely directed end face 25 creates a circular edge which, at the same time, forms a punching bezel 26. One portion of this punching bezel is pressed against the blank, in particular in this case against the side tabs 19, 20. The rectilinear punch cut 21 is applied by the punching bezel 26. A cylindrical portion of the punching piece 24 which adjoins the punching bezel 26 applies the deformation, thereby forming the convexity 22.

The punching piece 24 interacts with a counter tool which is located on the opposite side of the blank or the side tabs 19, 20. In this case, the counter tool is a peripheral portion 27 of a rotatingly movable counter roller 28. This counter roller is provided with a depression 29 in the effective peripheral portion 27. The depression 29 corresponds in shape to the adjacent portion of the punching piece 24. The punching piece enters the depression 29 in a positively fitting manner with the punching bezel 26 and the adjacent portion of the cylindrical shell and thereby punches and deforms the cardboard. Accordingly, this depression is provided with a flat surface which corresponds to the end face 25 of the punching piece 24 and with a curved face which corresponds to the shell of the punching piece 24.

The step of forming or applying the projections 10 is integrated into the continuous process of manufacturing the package. The projections 10 are formed during the continuous conveyance of the blanks or the web of material. For this purpose, the punching tool, namely the punching piece 24, is also disposed on a rotating means, namely on a punching roller 30. In the region in which the punching piece 24 is attached, this punching roller is provided with a cutout 31 and a recess 32. A projection 33 which protrudes in the radial direction is left between cutout and recess. On its outside, this projection 33 has the peripheral surface of the punching roller 30. The pin-like punching piece 24 is affixed parallel to a tangential (imaginary) plane, i.e. transverse to the axis of the punching roller 30, in the region of the projection 33. The projection 33 is provided with a transverse-axial bore 34. The punching piece 24 sits within this bore and bears against a shoulder 35. A fastening bolt 36 retains the punching piece 24 in this position.

The projection 33 is designed such that a radially outward region at the free end of the punching piece 24 is free on the radially outward side of the punching roller 30. A radially outward portion of the punching bezel 26 is located in the path of movement of the counter roller 28 which is also driven to rotate. The distance between counter roller 28 and punching roller 30 is defined such that an outer marginal portion of the punching bezel 26 enters the depression 29 of the counter roller 28 which is moved precisely synchronously with the punching roller 30. Behind or adjacent the recess 29, the counter roller 28 is also provided with a depression 37.

In the present case, counter roller 28 and punching roller 30 are each formed from two roller halves. Consequently, the parts or halves of the rollers which serve as tools can be readily exchanged.

Figure 2:
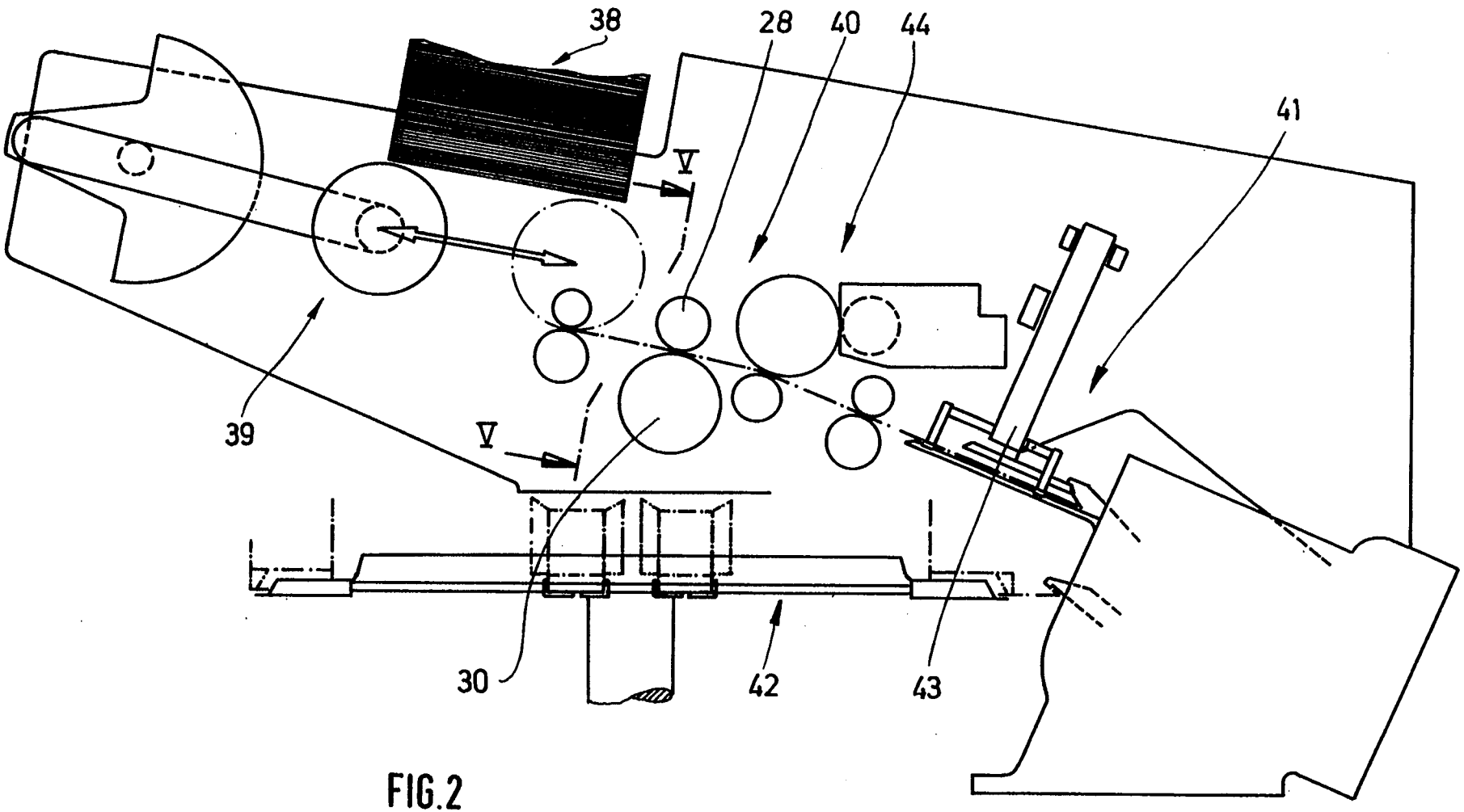
FIG. 2 shows a schematic side view of an apparatus for the handling of blanks until they are transferred to a folding turret.
Figure 3:
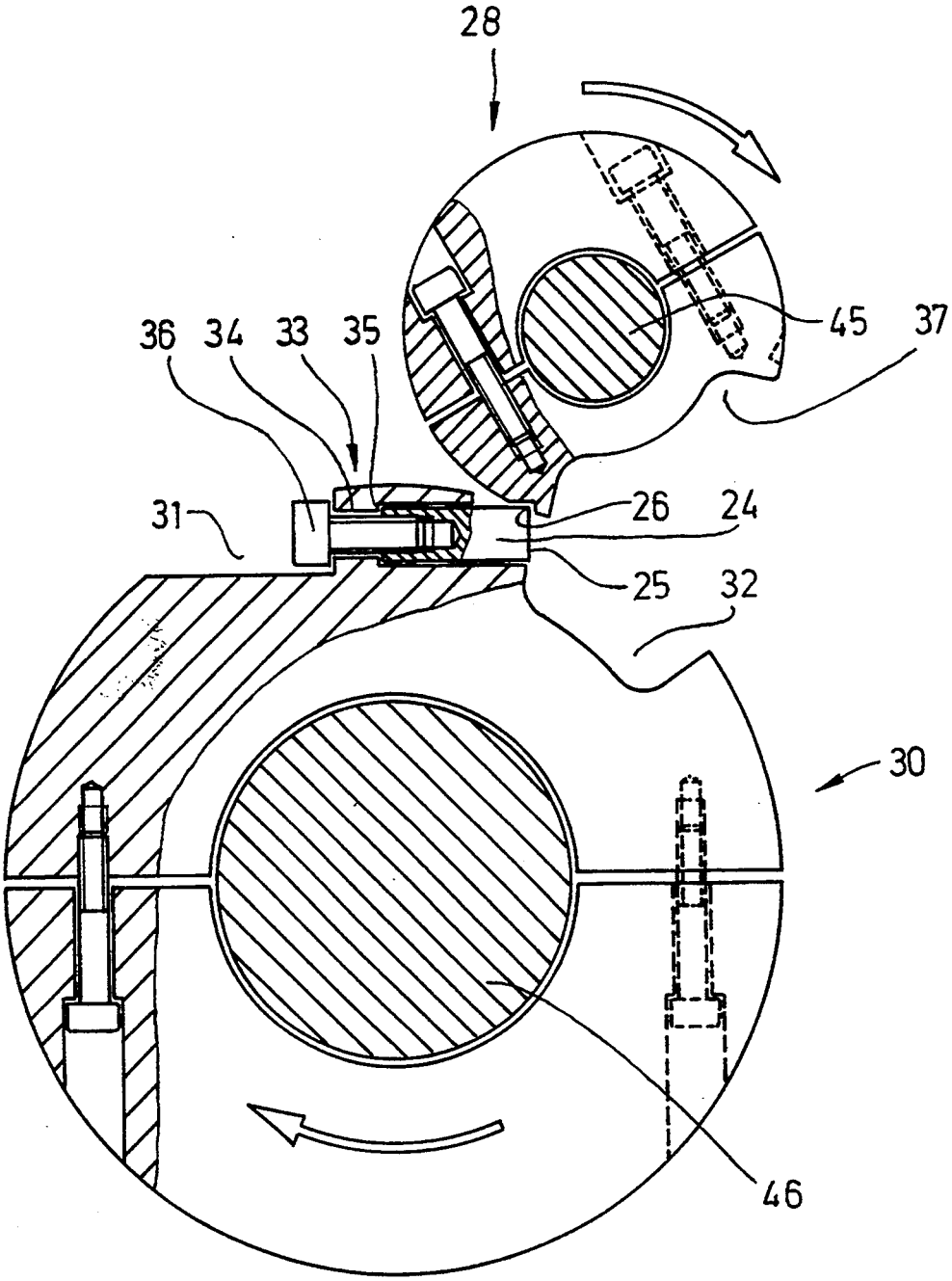
FIG. 3 shows an enlarged side view or vertical section (taken along line III—III of FIG. 5) of a detail of the apparatus of FIG. 2, namely punching and embossing means.
Figure 4:
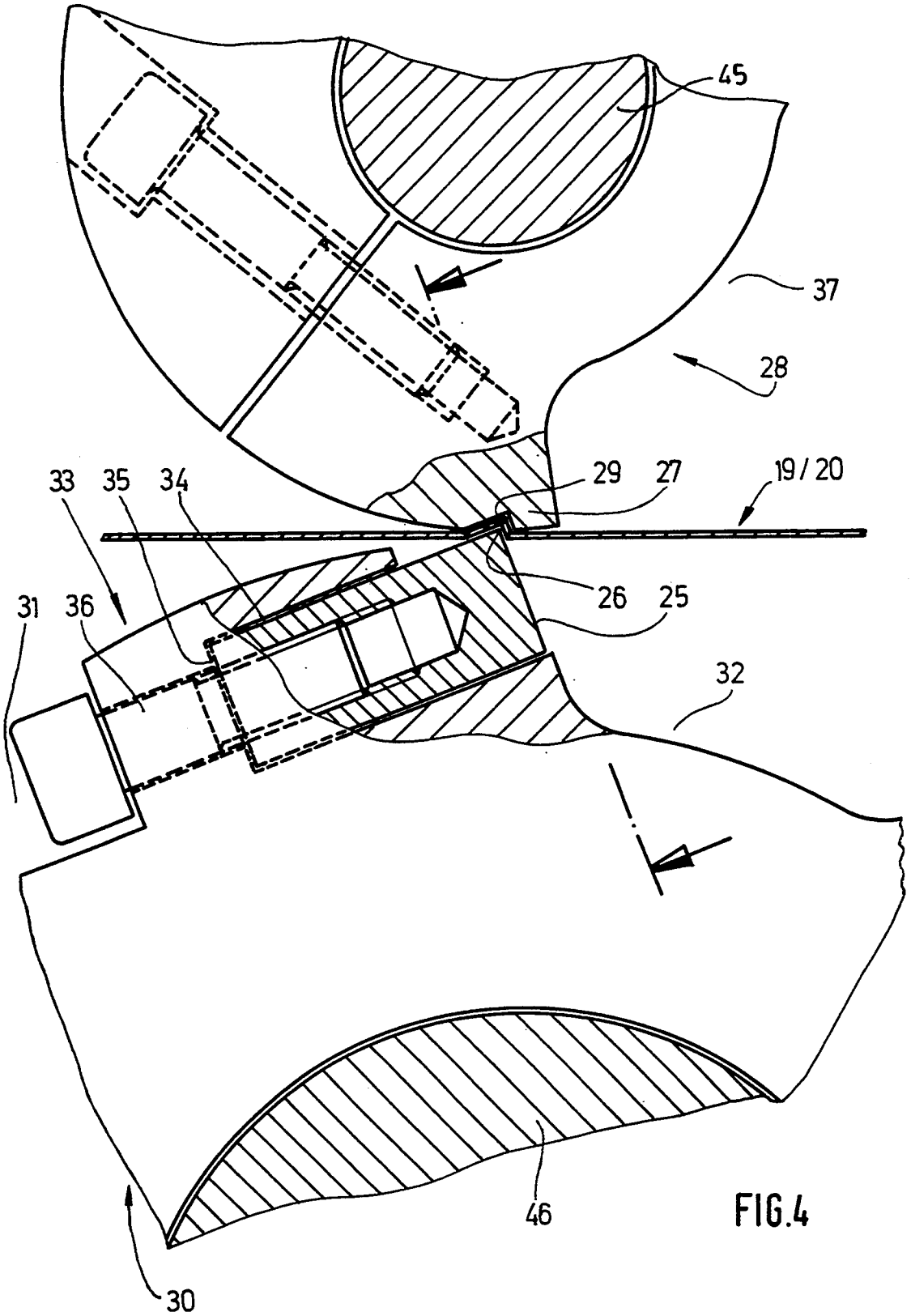
FIG. 4 shows an even further enlarged fraction of the detail of FIG. 3.
Figure 5:
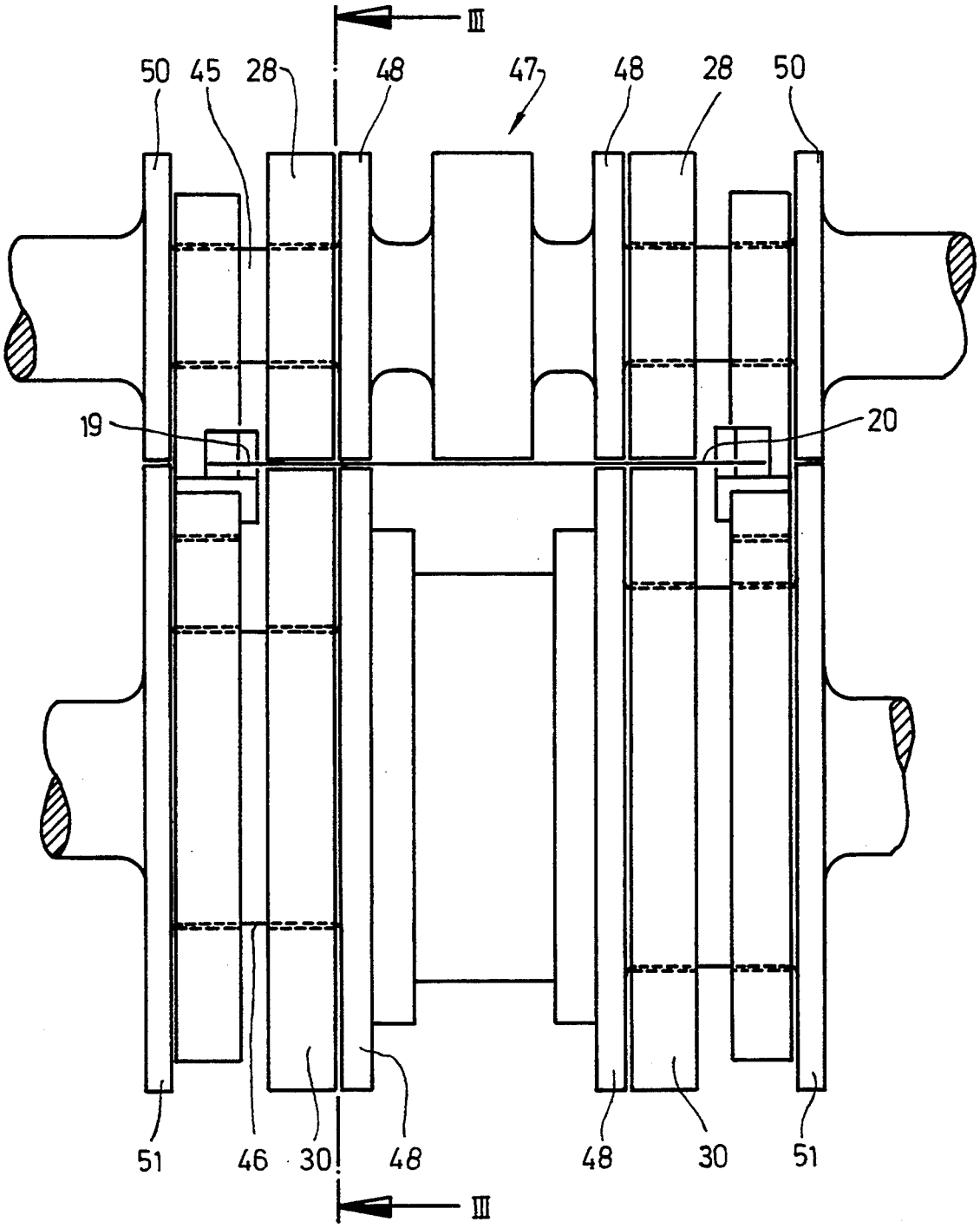
FIG. 5 shows an enlarged view of the punching or embossing means of FIG. 3, taken a long the line V—V of FIG. 2.
Figure 6:
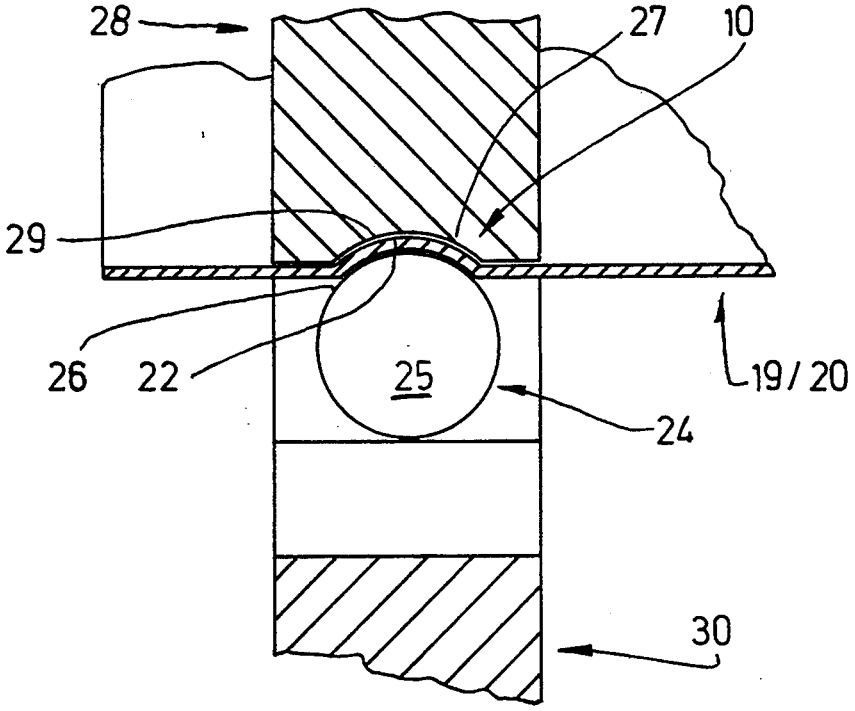
FIG. 6 shows a detail of the representation of FIG. 4, in particular a view of the punching and embossing means, taken a long the line VI—VI of FIG. 4.
Figure 7:
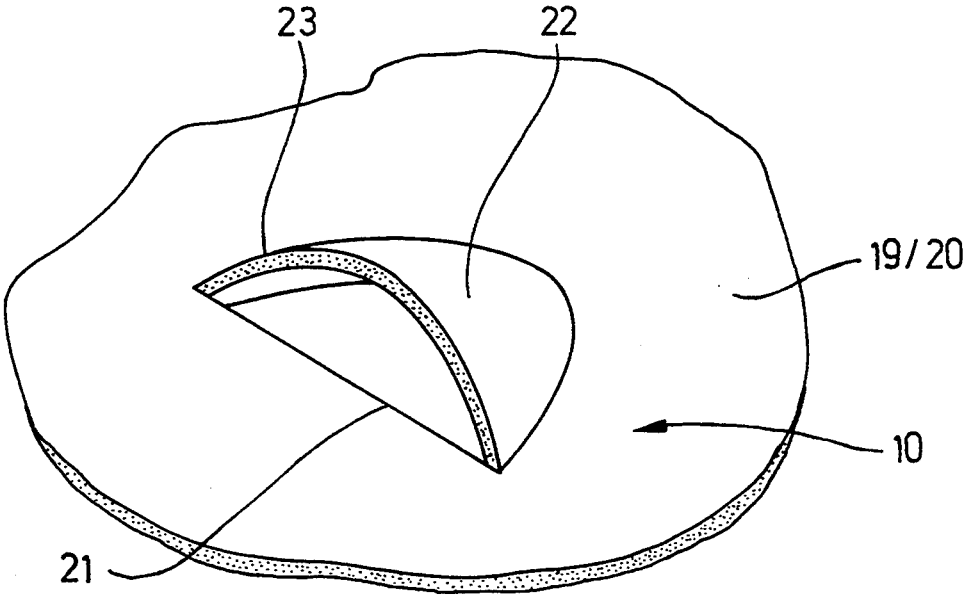
FIG. 7 shows a greatly enlarged perspective view of a stop or projection which is made by the punching and embossing tools.

As is evident from FIG. 5, counter roller 28 and punching roller 30 are means with complex structures. Counter roller 28 and punching roller 30 are disks which take effect essentially only in the region of the projections 10 which are to be formed. The disks are mounted on rotatingly driven shafts 45, 46. Further tool disks for the shaping of the blank are mounted on these shafts. A coding roller 47 is located on the upper shaft 45 in the middle between the laterally mounted counter rollers 28 and punching rollers 30. This coding roller has to apply a (numerical) stamping to the blank. Additionally, transport disks 48, 49 are located on the shafts 45 and 46. These transport disks are responsible for a precise conveyance of the blank. The distance between the shell surfaces of these transport disks 48, 49 is therefore precisely adjusted to the thickness of the blank. Moreover, lateral flanged wheels 50, 51 are disposed on the shafts 45, 46 and act as supports. The unit for applying projections 10 or stops which has been described in the foregoing can be integrated into the manufacturing process for packages, especially hinge-lid packs, in the best possible way. FIG. 2 schematically illustrates the relevant part of such a pack aging machine. The blanks are extracted individually from a blank magazine 38 by an extraction means (a so-called transfer roller). Thereafter, the blanks are conveyed along a downwardly inclined transport path 40 into a feed station above a folding turret 42 which has a disk-like design and rotates in a horizontal plane. The blanks are introduced into pockets of the folding turret 42 by a downwardly movable plunger 43.

The unit for applying the projection 10 is integrated into the transport path 40. In the present case, counter roller 28 and punching roller 30 are located upstream of a gluing unit 44 in the conveying direction. The gluing unit 44 applies adhesive spots to the side tabs 19, 20 of the blank.

What is claimed is:

1. A hinge-lid pack for cigarettes which is made of thin cardboard, said pack comprising:

a) a lower box part (11) having box side panels (17, 18);

b) a hinge-lid adjoining a top of said lower box part (11);

c) a projecting collar (13) inserted into said lower box part (13); and d) collar side walls (15, 16) abutting an inside of said box side panels (17, 18) in an upper region thereof, and partly projecting therefrom, e) said box side panels (17, 18) having inwardy directed projections (10) which are directed into the inside of the pack and which support said collar (13) and said collar side walls (15, 16), f) each projection (10) being formed by an inwardly directed convexity (22) having an upper edge (23) which supports the collar (13), g) said upper edge (23) extending transversely relative to an upright direction of the pack, and being separated from a corresponding and also transversely extending punch cut (21) in each side panel (17, 18), h) said convexity (22) downwardly merging into said side panel (17, 18).

2. The pack as claimed in claim 1, wherein said upper edge (23) and the convexity (22) have an arcuate shape.

3. The pack as claimed in claim 1, wherein said upper edge (23) has an arcuate shape.

4. The pack according to claim 2, wherein said convexity (22) has a cross section which corresponds to a cylindrical workpiece with a cylindrical shell surface which is directed upwards in an inclined manner.

5. The pack according to claim 3, wherein said arcuate shape of the edge (23) extends across approximately 45° of a circle.

6. The pack as claimed in claim 1, wherein each box side panel (17, 18) is formed from two inner side tabs (19, 20) provided with said projections.

7. The pack according to claim 1, wherein each of said projections (10) is formed by a punch cut with simultaneous embossing for simultaneously forming said upper edge (23) and said convexity (22).

8. A package which is made from cardboard, and which comprises a) a wall (17, 18) having a deformation defining a projection (10), b) said projection (10) having an inwardly directed convexity (22) with an edge (23), c) said edge (23) being separated from a corresponding punch cut (21) in said wall (17, 18), d) said convexity (22) merging into said wall (17, 18) in a direction opposite to said edge (23).

9. The pack as claimed in claim 8, wherein said edge (23) and the convexity (22) have an arcuate shape.

10. The pack as claimed in claim 8, wherein said edge (23) has an arcuate shape.

11. The pack according to claim 9, wherein said convexity (22) has a cross section which corresponds to a cylindrical workpiece with a cylindrical shell surface which is directed in an inclined manner.

12. The pack according to claim 10, wherein said arcuate shape of the edge (23) extends across approximately 45° of a circle.

13. The pack as claimed in claim 8, wherein the wall (17, 18) is formed from two inner side tabs (19, 20) provided with projections.

14. The pack according to claim 8, wherein said projection (10) is formed by a punch cut with simultaneous embossing for simultaneously forming said edge (23) and said convexity (22).

* * * * *